US005278374A

United States Patent [19]

Takagi et al.

[11] Patent Number: 5,278,374

[45] Date of Patent: Jan. 11, 1994

[54] ASSEMBLY WITH AN ASYMMETRICAL RESILIENT SPRING

[75] Inventors: Takeyuki Takagi, Nagoya; Yoshitsugu Sato, Kuwana; Makoto Watanabe, Nagoya; Isao Mochizuki, Gifu, all of Japan

[73] Assignee: Brother Kogyo Kabushiki Kaisha, Nagoya, Japan

[21] Appl. No.: 967,053

[22] Filed: Oct. 28, 1992

[30] Foreign Application Priority Data

Feb. 14, 1992 [JP] Japan ..... 4-5889[U]

[51] Int. Cl.[5] ..... H01H 13/52

[52] U.S. Cl. ..... 200/513; 200/344

[58] Field of Search ..... 200/517, 513, 344

[56] References Cited

U.S. PATENT DOCUMENTS

| | | | |
|---|---|---|---|
| 3,174,685 | 3/1965 | Swanson . | |
| 3,857,007 | 12/1974 | Leuenberger . | |
| 4,392,037 | 7/1983 | Fleming | 200/344 |
| 4,433,225 | 2/1984 | Cowles | 200/344 |
| 4,492,829 | 1/1985 | Rodrique | 200/513 X |
| 4,560,844 | 12/1985 | Takamura et al. . | |
| 4,560,845 | 12/1985 | Takamura et al. . | |
| 4,580,022 | 4/1986 | Oelsch et al. | 200/344 |
| 4,735,520 | 4/1988 | Suzuki et al. . | |
| 4,902,862 | 2/1990 | Oelsch et al. | 200/344 |

FOREIGN PATENT DOCUMENTS

| | | | |
|---|---|---|---|
| 0134509 | 3/1985 | European Pat. Off. . | |
| 0142593 | 5/1985 | European Pat. Off. . | |
| 0295437 | 12/1988 | European Pat. Off. . | |
| 3044414 | 6/1982 | Fed. Rep. of Germany | 200/513 |
| 2175105 | 10/1973 | France . | |
| 2554630 | 5/1985 | France | 200/513 |
| 2-5236 | 1/1990 | Japan | 200/344 |
| 4-76224 | 7/1992 | Japan . | |

*Primary Examiner*—Renee S. Luebke
*Attorney, Agent, or Firm*—Oliff & Berridge

[57] ABSTRACT

A keyswitch assembly is provided with a scissors-type lever positioned over a rubber spring having the shape resembling an asymmetrical inverted cup. The thickness of a portion of the side wall of the rubber spring on one side is greater than the thickness of a side wall on the opposed side of the rubber spring. Also, the top surface of the rubber spring is inclined so that the height of a portion of the outer surface of the upper wall of the rubber spring nearer to one side of the lever is smaller than that of the height of the spring nearer to the other side of the lever.

23 Claims, 5 Drawing Sheets

ASSEMBLY WITH AN ASYMMETRICAL RESILIENT SPRING

BACKGROUND OF THE INVENTION

1. Field of the Invention

The present invention relates to a keyswitch assembly for use on a keyboard to be used as the input device of a word processor or a personal computer.

2. Description of Related Art

A prior art keyswitch assembly, such as disclosed in U.S. Pat. Nos. 4,580,022 and 4,560,845, for use on a keyboard has a key provided with a stem, a base plate provided with a guide member having a hole receiving the stem of the key to guide the key for vertical movement, a rubber spring provided with a contact on the inner surface of the upper wall thereof and disposed below the stem, and a switching device, such as a membrane switch consisting of electric contacts formed on a flexible sheet.

In a keyswitch assembly disclosed in U.S. Pat. No. 4,580,022, a key of a relatively large size as compared with corresponding electrical contacts, such as a space key, is supported on a key support mechanism formed by pivotally joining a pair of support levers in the middle portions thereof in a scissors-like form. The key is placed on a base plate to enable the key to move downward in a level position without being tilted when depressed.

Recent progressive reduction in the thickness of keyboards requires reduction in the thickness of the key. However, on the other hand, the stroke of the key must be sufficiently large to facilitate keystroke operation and to ensure reliable keystroke.

However, if the thickness of the keyboard provided with the foregoing prior art keyswitch assembly having the key provided with the stem projecting from the lower surface thereof and the guide member having the hole receiving the stem of the key to guide the key for vertical movement is desired to be reduced, the length of a sliding portion of the stem in sliding engagement with the guide member must be reduced. If the length of the sliding portion of the stem is reduced, the key is liable to tilt relative to the guide member and, consequently, the stem is liable to slide awkwardly in the guide member when the key is depressed. Therefore, the key is unable to be operated smoothly and lightly. If the length of the sliding portion of the stem in engagement with the guide member is increased to ensure smooth movement of the key, the stroke of the key is reduced. Thus, the effort of reducing the thickness of the keyboard and the effort of securing a sufficiently large key stoke are contradictory.

Further, in order to ensure accurate operation by the operator, satisfactory tactile sensation upon depression of the keys is necessary. In prior art switching members which utilize flexible membrane switches, the shape of the switching device is designed on the assumption that the switch is depressed linearly, and upon depression, the switching device is designed to buckle. Such devices are formed of membranes having a uniform thickness. However, a membrane of uniform thickness will not provide satisfactory tactile feedback since there is not a sufficiently sharp change in the resistance of the key against depression at the moment the electrical contact is closed. Further, if the key is not pressed perfectly linearly downward, the pressure will be inefficiently transferred to the switching device and the switching device will buckle indefinitely.

SUMMARY OF THE INVENTION

It is an object of the present invention to provide a keyswitch assembly having a key, a rubber spring and a mechanism capable of easily and properly buckling the rubber spring, wherein the keyswitch is capable of giving a user a satisfactory touch of the key.

Another object of the present invention is to provide a keyswitch assembly having a key and a key support mechanism supporting the key which is formed by pivotally joining a first support lever and a second support lever in a scissors-like form with a rubber spring disposed under the key support mechanism. The assembly is capable of applying pressure perpendicularly to the upper surface of the rubber spring to transmit the pressure applied to the key efficiently to the rubber spring.

A further object of the present invention is to provide a keyswitch assembly having a key and a key support mechanism supporting the key which is formed by pivotally joining a first support lever and a second support lever in a scissors-like form with a rubber spring disposed under the key support mechanism. The assembly is capable of preventing the slip of the intersection of the first and second support levers on the upper surface of the rubber spring to prevent abrading the upper wall of the rubber spring.

In one aspect of the present invention, a keyswitch assembly comprises: a key; a base plate disposed under the key; a key support mechanism having one end connected to the lower surface of the key and the other end connected to the base plate to support the key for vertical movement, a cup-shaped rubber spring capable of being elastically deformed by the key support mechanism when the key is depressed; and a switching device to be operated for switching action by the elastically deformable rubber spring; wherein the key support mechanism is formed by pivotally joining a first support lever and a second support lever in their middle portions in a scissors-like form, the upper end of the first support lever is connected slidably to the lower surface of the key, the lower end of the first support lever is connected pivotally to the base plate, the upper end of the second support lever is connected pivotally to the lower surface of the key, the lower end of the second support lever is connected slidably to the base plate, the rubber spring is disposed under the intersection of the first and second levers, the thickness of one portion of the side wall of the rubber spring is smaller than that of the other portion of the same, the upper wall of the rubber spring is pressed by portions of the lower surfaces of the first and second support levers around the intersection of the first and second support levers, and the outer surface of the upper wall of the rubber spring is inclined so as to extend substantially perpendicularly to the path of the intersection of the first and second support levers.

The upper wall of the rubber spring is inclined so that a portion of the upper surface of the upper wall on the side of the lower end of the first support lever pivotally connected to the base plate is lower than the opposite portion of the upper wall on the side of the lower end of the second support lever slidably connected to the base plate, the thickness of a portion of the side wall of the rubber spring corresponding to the lower portion of the upper wall is greater than that of the opposite portion of the side wall.

When the key of the keyswitch assembly of the present invention is depressed, the first support lever turns downward on the lower end thereof pivotally connected to the base plate. Therefore, the intersection of the first and second support levers pivotally joined in their middle portions in a scissors-like form presses the upper wall of the rubber spring obliquely downward.

Since the portion of the side wall of the rubber spring having a smaller thickness is liable to buckle more easily than the portion of the side wall of the same having a greater thickness, the clicking touch of the key at the moment of the switching action of the switching device is satisfactory.

Since the outer surface of the upper wall of the rubber spring is inclined substantially perpendicularly to the path of the intersection of the first and second support levers, pressure acts in a direction perpendicular to the outer surface of the upper wall and the point of contact between the intersection of the first and second support levers and the outer surface of the upper wall shifts scarcely, the side wall of the rubber spring can be easily deformed.

Furthermore, since the width of the portion of the side wall of the rubber spring having a greater thickness and corresponding to the lower portion of the upper wall is smaller than that of the portion of the side wall having a smaller thickness and corresponding to the higher portion of the upper wall, the latter portion of the side wall of the rubber spring can be buckled more easily and more greatly than the former portion of the same. Consequently, a movable contact attached to the inner surface of the upper wall of the rubber spring can be moved downward in a position substantially parallel to the switching device even if a force parallel to the switching device acts on the upper wall of the rubber spring and the entire area of the movable contact can be brought into contact simultaneously with the switching device for satisfactory switching action.

BRIEF DESCRIPTION OF THE DRAWINGS

A preferred embodiment of the present invention will be described in detail with reference to the accompanying drawings, wherein.

DETAILED DESCRIPTION OF THE PREFERRED EMBODIMENTS

A keyswitch assembly in a preferred embodiment according to the present invention will be described hereinafter with reference to FIGS. 1 to 6.

Figure 1:
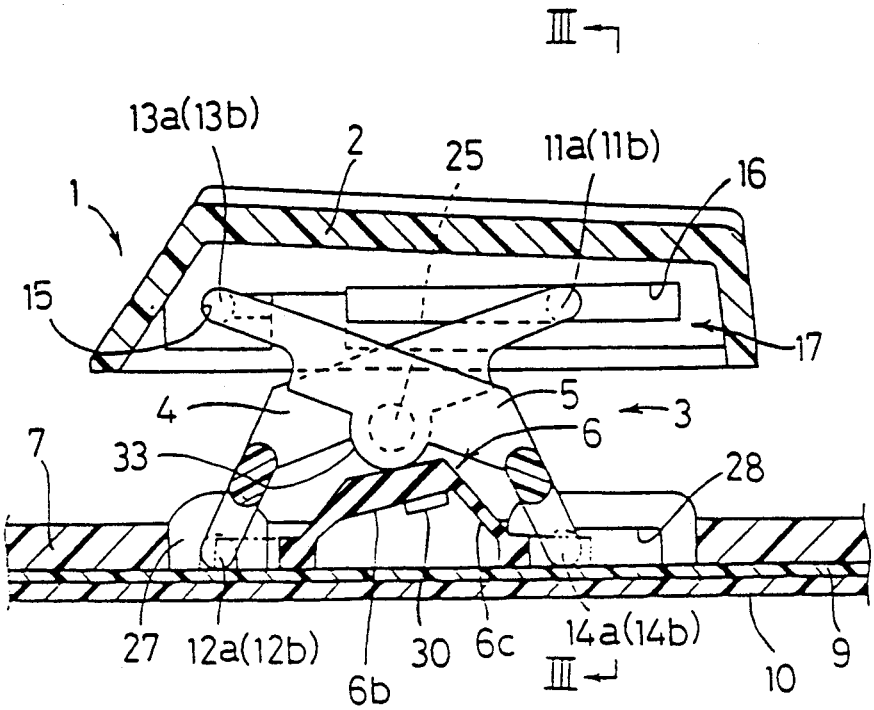
FIG. 1 is a sectional side view of a keyswitch assembly in a preferred embodiment according to the present invention.
Figure 2:
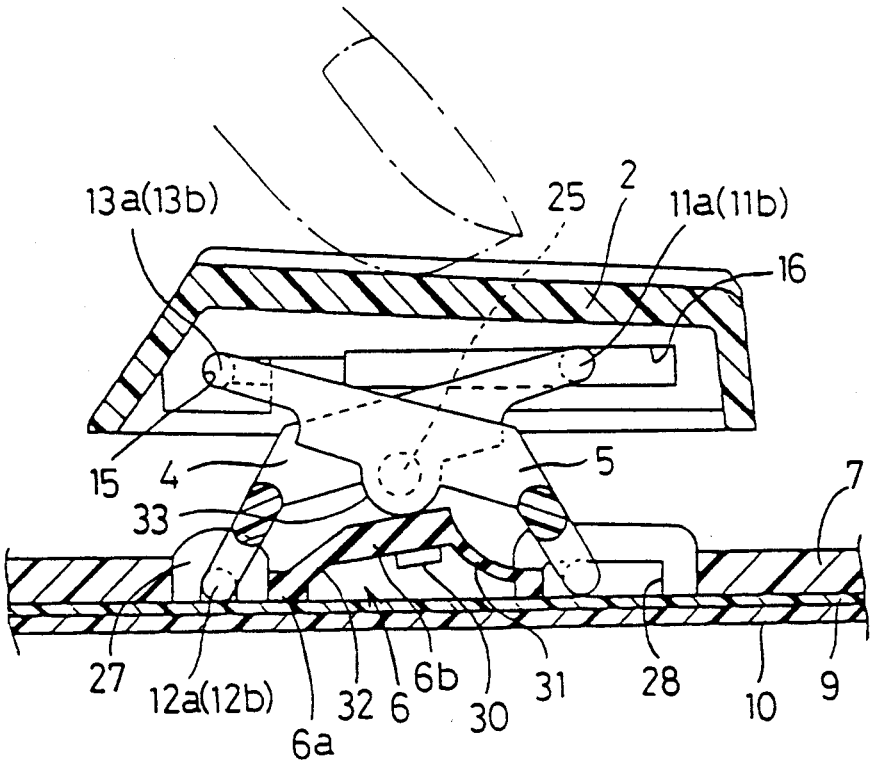
FIG. 2 is a sectional side view of the keyswitch assembly of FIG. 1 in a state where the key is depressed.

Referring to FIG. 1, a keyswitch assembly 1 has a key 2; a key support mechanism 3 formed by pivotally joining a first support lever 4 and a second support lever 5 in a scissors-like form; an asymmetric cup-shaped rubber spring 6; a base plate 7 preferably formed of a synthetic resin, supporting the key support mechanism 3 thereon and provided with a substantially rectangular opening 26; a flexible printed wiring or circuit board 9 attached to the lower surface of the base plate 7 so that switching elements 29 (FIG. 5) are disposed in the opening 26 of the base plate 7; and a reinforcing plate 10 attached to the lower surface of the flexible printed wiring board 9.

A character such as an alphabetic character or a numeral is formed on the upper surface of the key 2, preferably formed of ABS resin by printing or stamping. A pair of connecting members 17 are formed integrally with or attached adhesively to the lower surface of the key 2. The pair of connecting members 17 are provided with circular recesses 15 for pivotally receiving pivots 13*a* and 13*b* formed on the upper end of the second support lever 5 and elongate recesses 16 for slidably receiving pivots 11*a* and 11*b* formed on the upper end of the first support lever 4.

Figure 4A:
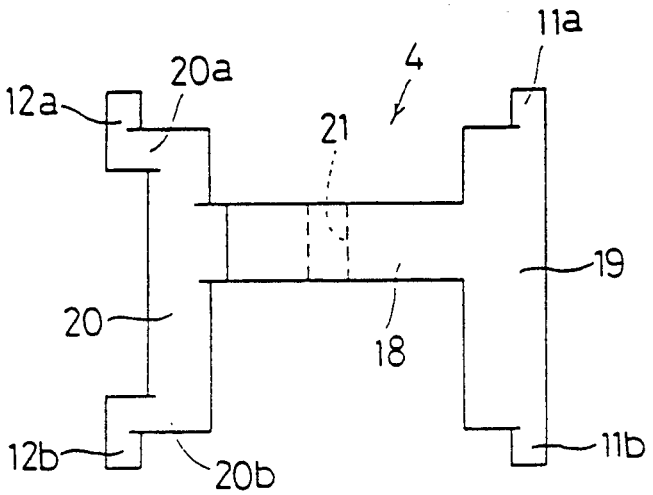
FIGS. 4(*a*) and 4(B) are plan views of a first support lever and a second support lever, respectively.
Figure 4:
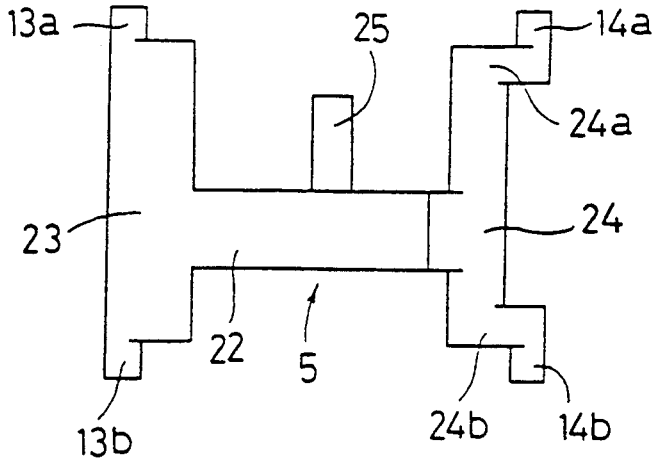

The first support lever 4 and the second support lever 5 are preferably formed of a glass fiber reinforced synthetic resin. As shown in FIG. 4(A), the first support lever 4 has a shape substantially resembling the letter H and consists of a body 18 provided with a lateral through hole 21, an upper bar 19 provided at its opposite ends with the pivots 11*a* and 11*b*, and a lower bar 20 provided at its opposite ends with the pivots 12*a* and 12*b*.

The second support lever 5 has a shape substantially resembling the letter H and consists of a body 22 having a shaft 25 laterally projecting from one side surface thereof, an upper bar 23 provided at its opposite ends with the pivots 13*a* and 13*b*, and a lower bar 24 provided at its opposite ends with pivots 14*a* and 14*b*. The shaft 25 of the second support lever 5 is fitted in the through hole 21 of the first support lever 4 to join the first support lever 4 and the second support lever 5 pivotally in a scissors-like linkage so that the first support lever 4 and the second support lever 5 are able to turn relative to each other. A semi-circular bearing surface 33 is formed at the intersection of levers 4 and 5 at the juncture between the through hole 21 and the shaft 25.

In this embodiment, the longitudinal distance between the axis of the through hole 21 of the first support lever 4 and the axis of the pivot 11*a* and the longitudinal distance between the axis of the through hole 21 and the axis of the pivot 12*a* are equal to each other. Also, the longitudinal distance between the axis of the shaft 25 of the second support lever 5 and the pivot 13*a* and the longitudinal distance between the axis of the shaft 25 and the pivot 14*a* are equal to each other. The key support mechanism 3 turns on the pivots 12*a* and 12*b* of the lower end of the first support lever 4 to move the key 2 vertically such that the key 2 remains parallel to the upper surface of the base plate when depressed.

Figure 5:
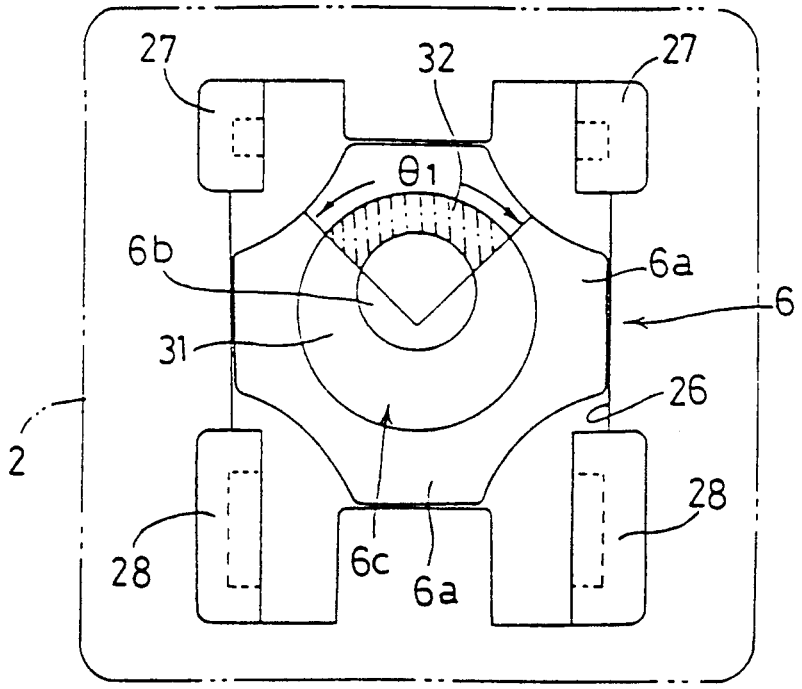
FIG. 5 is a plan view of a rubber spring fitted in an opening formed in a base plate.
Figure 6:
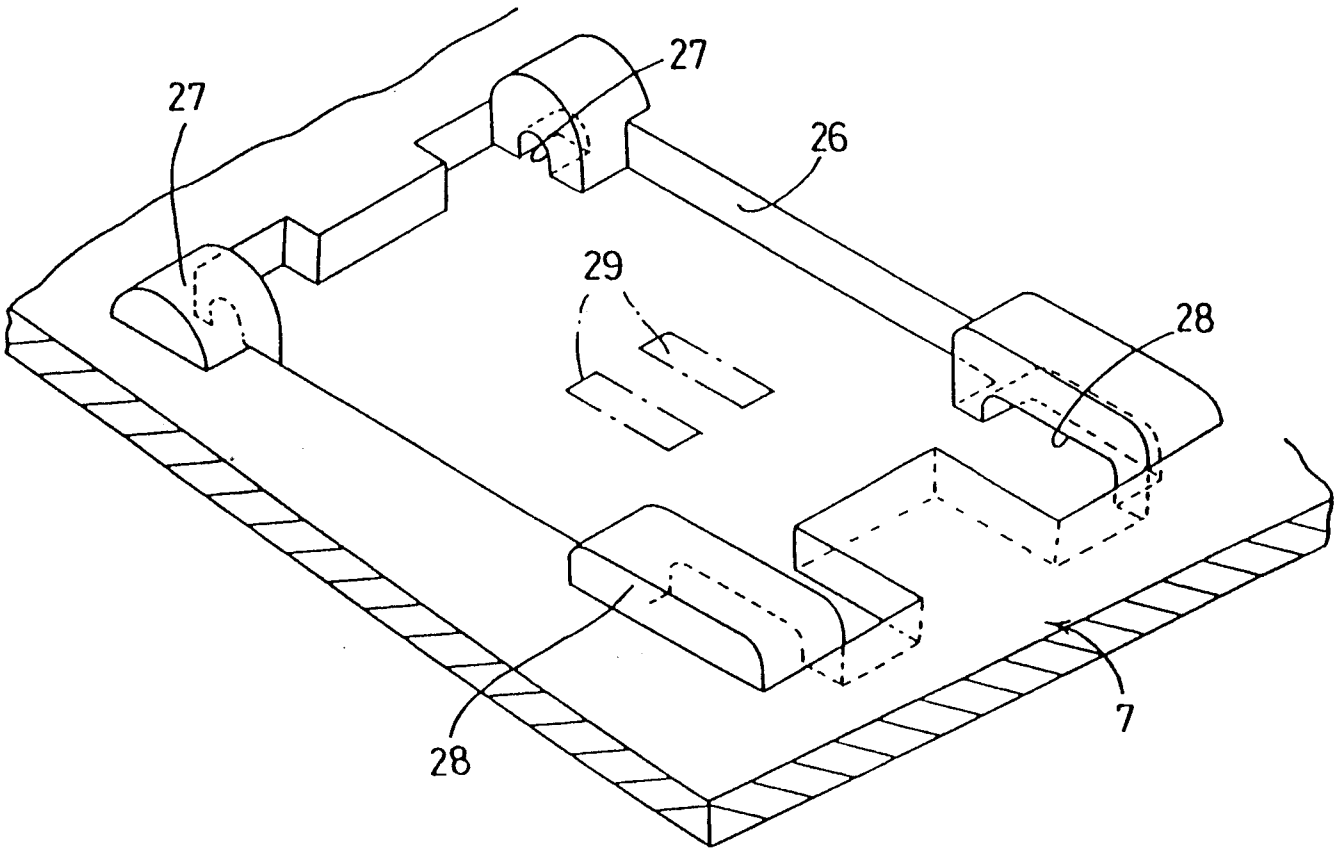
FIG. 6 is a perspective view of a portion of a base plate around an opening for receiving a rubber spring.

FIG. 6 shows a portion of the base plate 7 in an enlarged perspective view. Preferably, the material forming the base plate 7 is different from the glass fiber reinforced synthetic resin forming the support levers 4 and 5. As seen in FIG. 5, a flange 6*a* formed around the open lower end of the cup-shaped rubber spring 6 fits the substantially rectangular opening 26 of the base plate 7. The base plate 7 is preferably formed in an integral piece by injection molding and is provided with a pair of downward open round recesses 27 at the opposite ends of one side of the opening 26 and a pair of downward open elongate recesses 28 at the opposite ends of the opposite side of the opening 26. The pivots 12*a* and 12*b* formed on the lower end of the first support lever 4 are received pivotally in the round recesses 27, respectively, and the pivots 14*a* and 14*b* formed on the lower end of the second support lever 5 are received slidably in the elongate recesses 28.

Figure 3:
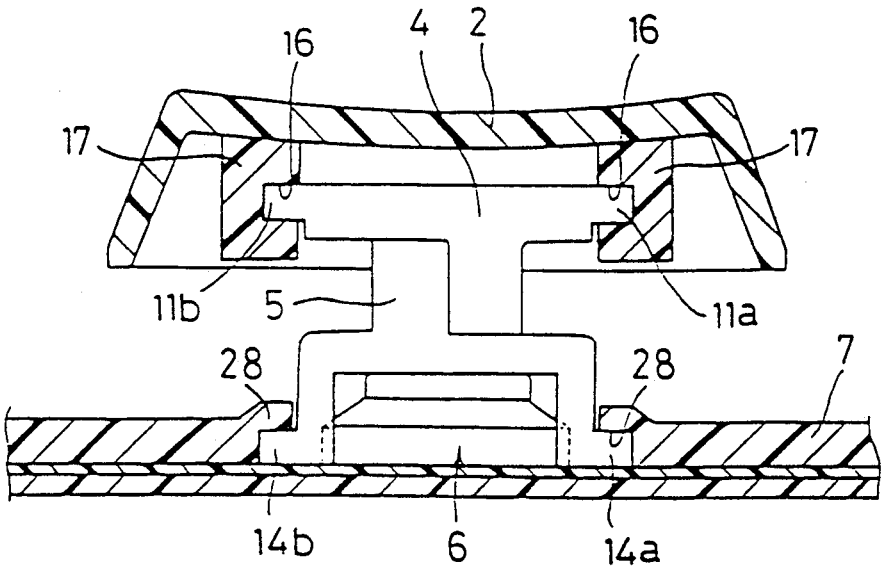
FIG. 3 is a sectional view taken on line III—III in FIG. 1.

The sizes and shapes of the pivots 11*a*, 11*b*, 14*b* and 14*b* and the elongate recesses 16 and 28 are determined so that the first support lever 4 and the second support lever 5 are substantially immovable in horizontal directions, as viewed in FIG. 3, and the pivots 11*a*, 11*b*, 14*a* and 14*b* are horizontally slidable, as viewed in FIG. 1. In operation, the end surfaces of the pivots (11*a*, 11*b*) and (14*a*, 14*b*) are in sliding contact with the bottom walls of the corresponding elongate recesses 16 and 28, respectively. Therefore, the shaft 25 does not work free from the through hole 21.

Referring to FIGS. 1, 2, 3 and 5, the spring 6 is fitted in the opening 26 of the base plate 7 so as to cover the switching elements (electric contacts) 29 of the printed wiring board 9. The spring 6 is preferably formed of electrically insulating silicone rubber or EPDM (ethylenepropylene diene methylene) and has, preferably in an integral piece, a circular upper wall 6*b* having a relatively large thickness, a side wall 6*c* having a shape resembling the side wall of a truncated cone, and a flange 6*a* of a relatively large thickness extending radially outward from the circumference of the open lower end of side wall 6*c*. A movable contact 30 formed of a conductive rubber is fixed to the inner surface of the upper wall 6*b* so as to be brought into contact with the switching elements 29 to connect the switching elements 29 electrically when the spring is depressed. It is also possible to form the rubber spring 6 of a conductive material, such as silicone rubber containing dispensed conductive powder, such as carbon black.

As shown in FIG. 1, the upper wall 6*b* of the rubber spring 6 is inclined so as to ascend from the side of the lower half of the first support lever 4 toward the side of the lower half of the second support lever 5. The thickness of a portion 31 of the side wall 6*c* nearer to the lower half of the second support lever 5 is less than the thickness of a portion 32 of the side wall 6*c* nearer to the lower half of the first support lever 4. As seen in FIG. 5, the thicker portion 32 may be formed in a portion of the side wall 6*c* corresponding to a sector having a center angle of $\Theta$ not greater than 180 degrees and the thinner portion 31 may be formed in the remaining portion of the side wall 6*c*.

When the key 2 is depressed, the thinner portion 31 and the thicker portion 32 of the side wall 6*c* buckle substantially simultaneously, which provides a satisfactory clicking touch of the key 2 when the upper wall 6*b* of the rubber spring 6 is clicked against the switching elements 29.

Since the outer inclined surface of the upper wall 6*b* of the rubber spring 6 is directly beneath the path of the intersection of the first support lever 4 and the second support lever 5 and contacts the bearing surface 33 tangentially, depressing the key 2 forces the bearing surface 33 to apply pressure to the upper wall 6*b* in a direction normal to the outer surface of the upper wall 6*b*. Thus, the point of contact between the outer surface of the upper wall 6*b* and the intersection of the first support lever 4 and the second support lever 5 shifts scarcely, and the side wall 6*c* of the rubber spring 6 can be easily deformed.

Since the height of the lower portion of the outer surface of the upper wall 6*b* on the side of the thicker portion 32 of the side wall 6*c* is less than the height of the higher portion of the side wall 6*c* on the side of the thinner portion 31, the distance between the flange 6*a* and the outer edge surface of the upper wall 6*b* of the thicker portion 32 of the side wall 6*c* is less than the distance between the flange 6*a* adjacent the thinner portion 31 of the side wall 6*c* and the outer edge surface of the upper wall 6*b*. Thus, as seen in FIG. 5, the upper wall 6*b* is positioned more closely to the flange 6*a* on the side of the thicker portion 62 of the side wall 6*c*. Accordingly, the thinner portion 31 of the side wall 6*c* can be buckled more easily and more greatly than the thicker portion 32 of the side wall 6*c*. Consequently, the entire area of the movable contact 30 attached to the inner surface of the upper wall 6*b* more closely to the thinner portion 31 can be brought into contact with the switching elements 29 when the key 2 is depressed in a position parallel to the surfaces of the switching elements 29. This improves the switching action of the movable contact 30 and the switching elements 29.

While advantageous embodiments have been chosen to illustrate the invention, it will be understood by those skilled in the art that various changes and modifications can be made therein without departing from the scope of the invention as defined in the appended claims.

For example, the flexible printed wiring board 9 provided with the switching elements 29 may be substituted by a wiring board provided with membrane switches. The keyswitch assembly can be applied also to a variable-capacity keyboard.

What is claimed is:

1. A keyswitch assembly comprising:

a key having a lower surface;

a base plate disposed under the key;

a key support mechanism disposed under said key, having an upper end connected to the lower surface of the key and a lower end connected to the base plate to support the key on the base plate for vertical movement with respect to the base plate;

a resilient spring shaped as an asymmetrical inverted cup with a base flange, a side wall and an upper wall, disposed under the key support mechanism and deformed elastically by the key support mechanism when the key is depressed, wherein a thickness of a portion of the side wall of the resilient spring on one side is greater than a thickness of the side wall on an opposed side of the resilient spring; and a switching device to be operated for switching action by the resilient spring when the resilient spring is deformed elastically.

2. The keyswitch assembly according to claim 1, wherein the resilient spring is disposed beneath the key support mechanism so that the upper wall thereof is pressed by the key support mechanism, and the upper wall of the resilient spring has an outer surface which is inclined so that a height of a portion of the outer surface nearer to one side of the key support mechanism is smaller than a height of a portion of the outer surface nearer to an opposed second side of the key support mechanism.

3. The keyswitch assembly according to claim 1, wherein the key support mechanism is a scissors-type linkage formed by coupling a first support lever and a second support lever, each lever having an upper end, a lower end and a pivot axis, the upper end of the first support lever connected substantially horizontally slidably to the lower surface of the key, the lower end of the first support lever connected pivotally to the base plate, the upper end of the second support lever connected pivotally to the lower surface of the key, and the lower end of the second support lever connected substantially horizontally slidably to the base plate.

4. The keyswitch assembly according to claim 3, wherein each first and second lever comprise an upper arm and a lower arm and a body, the upper arm and the lower arm being generally perpendicularly disposed to the body, and the lower arm of the first lever and the upper arm of the second lever having pivot means for pivoting with the base plate and the key respectively.

5. The keyswitch assembly according to claim 4, wherein the first lever has a shaft extending laterally from the body and the second lever has a hole extending laterally through the body, the shaft being rotatably engaged with the hole.

6. The keyswitch assembly according to claim 1, wherein the spring is rubber.

7. The keyswitch assembly according to claim 1, wherein the spring has a base flange and the side wall is annular.

8. The keyswitch assembly according to claim 1, wherein the thicker portion of the side wall of the spring is defined by an arc of 180 degrees or less.

9. The keyswitch assembly according to claim 1, wherein the base flange of the spring has a central longitudinal axis and the upper wall of the spring is positioned off center with respect to the axis.

10. The keyswitch assembly according to claim 1, wherein the upper wall of the spring has an upper surface, the upper surface being inclined with respect to the lower surface of the key.

11. The keyswitch assembly according to claim 1, wherein the switching device includes an electrical contact disposed in the spring on a lower surface of the upper wall.

12. The keyswitch assembly according to claim 11, wherein the contact is located closer to the portion of the side wall which is less thick than the remaining portion of the side wall.

13. A keyswitch assembly comprising:

a key having a lower surface;

a base plate disposed under the key;

a key support mechanism having one end connected to the lower surface of the key and the other end connected to the base plate to support the key on the base plate for vertical movement with respect to the base plate;

a resilient spring shaped as an inverted cup with a base flange, a side wall and an upper wall with an outer surface, disposed under the key support mechanism and capable of being deformed elastically by the key support mechanism when the key is depressed, the outer surface of the upper wall being inclined with respect to the lower surface of the key and in tangential contact with the key support mechanism when the key is depressed; and a switching device to be operated for switching action by the resilient spring when the resilient spring is deformed elastically.

14. The keyswitch assembly according to claim 13, wherein a thickness of a portion of the side wall of the resilient spring on one side is greater than a thickness of the side wall on an opposed side of the spring.

15. The keyswitch assembly according to claim 14, wherein the thicker portion of the side wall of the spring is defined by an arc of 180 degrees of less.

16. The keyswitch assembly according to claim 13, wherein the key support mechanism comprises a scissors-type linkage having a first lever and a second lever pivotally connected along a pivot axis, the first lever having an upper end connected substantially horizontally slidably to the lower surface of the key and a lower end connected pivotally to the base plate, the second lever having an upper end connected pivotally to the lower surface of the key and a lower end connected substantially horizontally slidably to the base plate.

17. The keyswitch assembly according to claim 16, wherein each first and second lever comprise an upper arm, a lower arm and a body, the upper arm and the lower arm generally perpendicularly disposed to the body, and the lower arm of the first lever and the upper arm of the second lever having pivot means for pivoting with the base plate and the key respectively.

18. The keyswitch assembly according to claim 17, wherein the first lever has a shaft extending laterally from the body and the second lever has a hole extending laterally through the body, the shaft being rotatably engaged with the hole.

19. The keyswitch assembly according to claim 13, wherein the spring is rubber.

20. The keyswitch assembly according to claim 13, wherein the spring has a base flange and the side wall is annular.

21. The keyswitch assembly according to claim 13, wherein the base flange of the spring has a central longitudinal axis and the upper wall of the spring is positioned off center with respect to the axis.

22. The keyswitch assembly according to claim 13, wherein the switching device includes an electrical contact disposed in the spring on a lower surface of the upper wall.

23. The keyswitch assembly according to claim 22, wherein the contact is located closer to the portion of the side wall which is less thick than the remaining portion of the side wall.

* * * * *